US008919785B2

(12) United States Patent
Wang et al.

(10) Patent No.: US 8,919,785 B2
(45) Date of Patent: Dec. 30, 2014

(54) COMPRESSIVE STRESS WATER STOPPER

(76) Inventors: Zhensheng Wang, Tianjin (CN); Zhenwei Gao, Tianjin (CN)

( * ) Notice: Subject to any disclaimer, the term of this patent is extended or adjusted under 35 U.S.C. 154(b) by 608 days.

(21) Appl. No.: 13/327,130

(22) Filed: Dec. 15, 2011

(65) Prior Publication Data

US 2012/0235364 A1 Sep. 20, 2012

(30) Foreign Application Priority Data

Mar. 18, 2011 (CN) ..... 2011 1 0065614

(51) Int. Cl.
*E04B 1/68* (2006.01)
*E04B 1/684* (2006.01)

(52) U.S. Cl.
CPC ..... *E04B 1/68* (2013.01)
USPC ..... 277/637; 52/396.02; 52/396.04

(58) Field of Classification Search
CPC ..... E04B 1/68; E04B 1/6806; E04B 1/6813
USPC ..... 277/637; 52/396.02, 396.03, 396.04, 52/396.06, 396.07
See application file for complete search history.

(56) References Cited

U.S. PATENT DOCUMENTS

| | | | | |
|---|---|---|---|---|
| 5,224,575 | A * | 7/1993 | Plichta | 191/22 R |
| 6,203,233 | B1 * | 3/2001 | Stanley | 403/28 |
| 6,520,303 | B1 * | 2/2003 | Malek et al. | 191/22 R |
| 2011/0225919 | A1 * | 9/2011 | Findlay | 52/396.04 |

FOREIGN PATENT DOCUMENTS

| | | | |
|---|---|---|---|
| CA | 2210733 | C * | 3/2004 |
| CN | 200410071859.8 | | 3/2006 |
| CN | 200710150062.0 | | 5/2009 |
| FR | 1225028 | A * | 6/1960 |
| GB | 1153467 | A * | 5/1969 |
| WO | WO 9513438 | A1 * | 5/1995 |

* cited by examiner

*Primary Examiner* — Vishal Patel
*Assistant Examiner* — Stacy Warren
(74) *Attorney, Agent, or Firm* — Ping Wang; Andrews Kurt LLP

(57) ABSTRACT

The present invention relates to a leakage proof member for buildings, particularly to a compressive stress water stopper, which functions as or substitutes a water stop strip in a concrete deformation joint. The compressive stress water stopper may be pre-installed before casting concrete or installed after concrete is cast. The compressive stress water stopper has an upper plate, a fork-shaped rubber plate, a tapered rubber plate and a lower plate whose screw holes are alternately inserted by a plurality of fastening bolts A and B which are fastened by fastening nuts, respectively. The stress and the adhering property of the bicomponent polysulfide rubber securely attach the fork-shaped sheets of the fork-shaped rubber plate to the concrete surfaces at the two sides of the deformation joint and seal the screw holes and the clearances in the concrete.

6 Claims, 7 Drawing Sheets

COMPRESSIVE STRESS WATER STOPPER

FIELD

The present application relates to a leakage proof member for buildings, particularly to a compressive stress water stopper, which is used to control water leakage from deformation joints of concrete blocks when water stop strips are absent or destroyed.

BACKGROUND

Usually, deformation joints are provided to underground or aquatic buildings when casting concrete to compensate future deformation and creeping of the concrete structure. To fulfill the waterproof of deformation joints, flexible water stop strips are often provided in deformation joints. However, water stop strips may be destroyed or removed for various reasons. Leakage will occur in such a case and currently there are no effective methods to control the leakage.

For dealing with the leakage caused by absence or destruction of water stop strips, the present prevailing method is to fill bicomponent polysulfide rubber or to provide follow-up water stop strips in the deformation joints. But both of the above methods have great technical defects.

As the rheology and viscosity of the filled bicomponent polysulfide rubber are rather high, it is difficult to fill, compact and seal the clearances in the deformation joints in the construction processes. Even if the sealing step is finished, the stretching performance of the solidified bicomponent polysulfide rubber is very limited. If the creeping amount of the deformation joints is too large, the solidified bicomponent polysulfide rubber will be torn and leakage will occur.

When a follow-up water stop strip is used, steel bars need to be provided under the concrete at the two sides of the deformation joint for fixing and sealing the follow-up water stop strip. If the deformation joint deforms, the follow-up water stop strip transmits huge tension to the concrete through these steel bars. Such tension may be large enough to tear the concrete. In that case, leakage will continue and the possibility of future repairing may be cut off.

Wherein

1. fork-shaped rubber plate; 2. base; 3. fork-shaped sheet; 4. layer of isolating agent; 5. layer of adhesive agent; 6. elongated channel; 7. screw hole; 8. concaved or convexed mating portion; 9. tapered rubber plate; 10. upper plate; 11. lower plate; 12. fastening bolt A; 13. fastening bolt B; 14. fixing device; 15. shaft; 16. latch; 17. deformation joint; 19. nut; 20. concrete; 21. conventional compressive stress water stopper; 22. internal angled compressive stress water stopper.

DETAILED DESCRIPTION

One objective of the present application is to provide a compressive stress water stopper that functions as or substitutes a water stop strip in a concrete deformation joint. The compressive stress water stopper may be pre-installed before casting concrete or installed after concrete is cast. The compressive stress water stopper of the present application can be securely adhered to the concrete at the two sides of the deformation joint by way of compressive stress thereof and can adapt to long-term deformation of the deformation joint. Thus, leakage of the concrete deformation joint is prevented, or the defect of a water stop strip in the concrete deformation joint is well remedied.

One technical solution of this application is a general compressive stress water stopper for a conventional concrete deformation joint.

Figure 1:
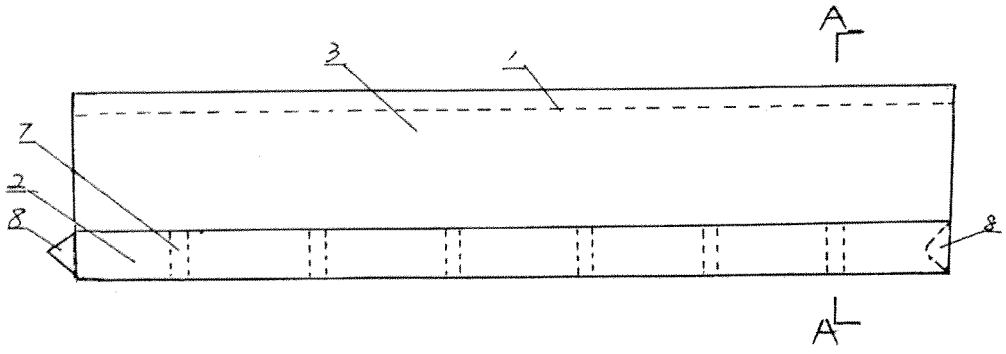
FIG. 1 is a front view of a fork-shaped rubber plate of this application.
Figure 2:
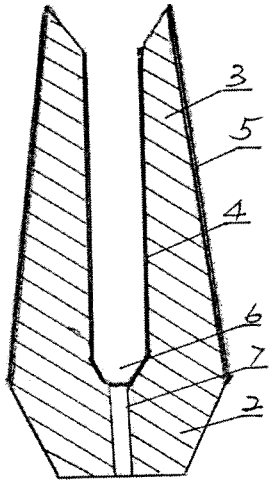
FIG. 2 is an enlarged illustration of FIG. 1 in the A-A section.
Figure 3:
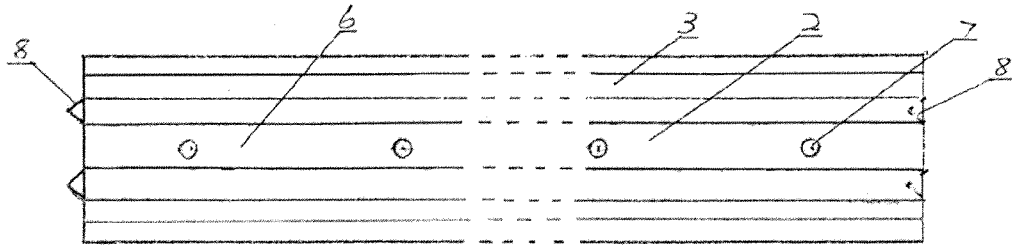
FIG. 3 is an enlarged illustration of the top view of the fork-shaped rubber plate of this application.
Figure 4:
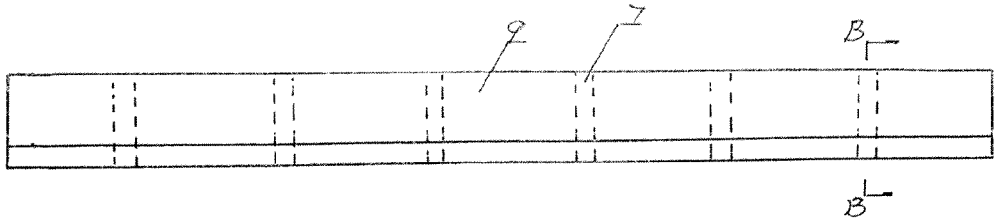
FIG. 4 is a front view of a tapered rubber plate of this application.
Figure 5:
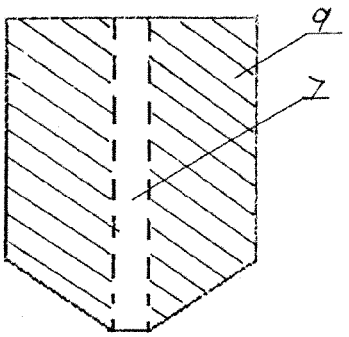
FIG. 5 is an enlarged illustration of FIG. 4 in the B-B section.
Figure 6:
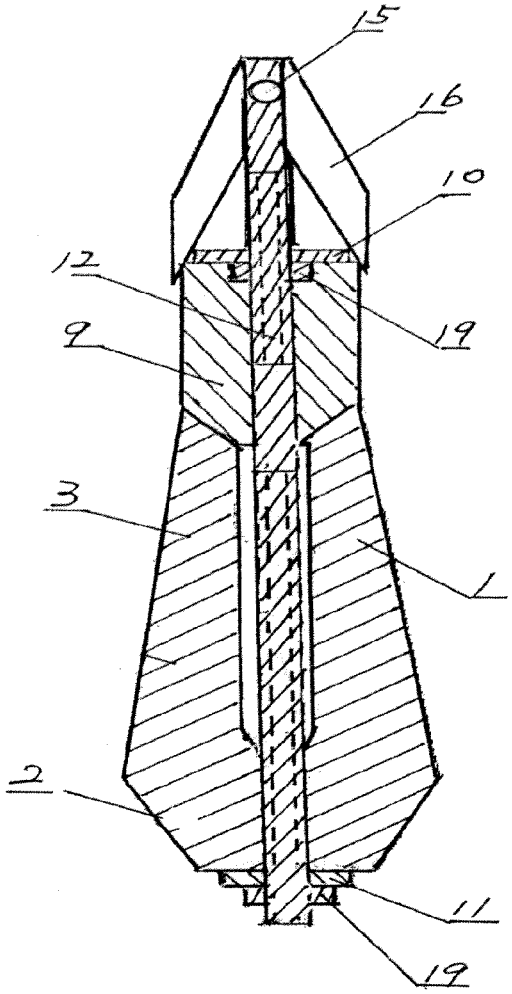
FIG. 6 is a sectional view of a fastening bolt A, an upper plate, a tapered rubber plate, a fork-shaped rubber plate and a lower plate.
Figure 7:
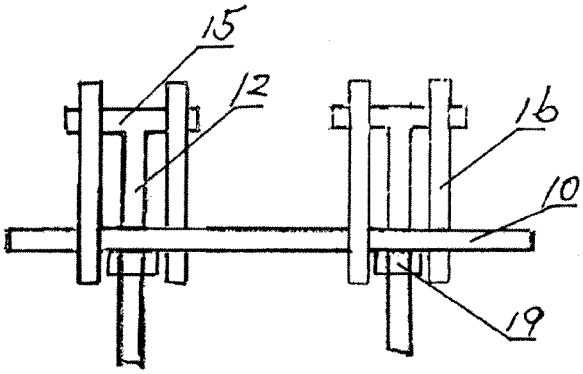
FIG. 7 is a front view of a fixing device of this application.
Figure 8:
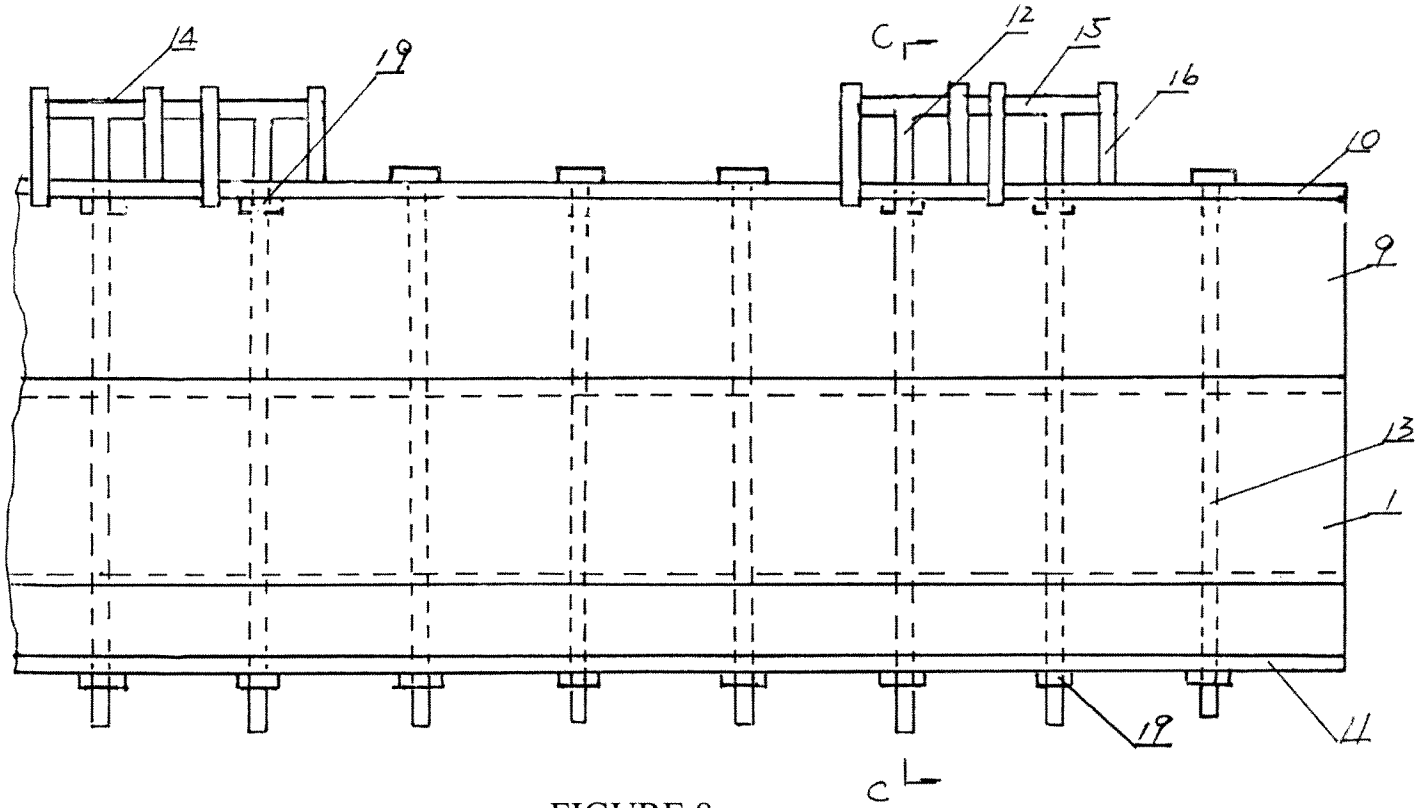
FIG. 8 is an overall view his application.

A compressive stress water stopper comprising a fork-shaped rubber plate, a tapered rubber plate, an upper plate, a lower plate and a plurality of fastening bolts A and B;

wherein the fork-shaped rubber plate is a highly resilient rubber plate having an elongated rectangular shape in a longitudinal direction and a groove-shaped cross-section; the fork-shaped rubber plate includes a base and a pair of opposed fork-shaped sheets attached to the base; the top of the fork-shaped sheet is a slope inclined inwardly; a layer of isolating agent is provided at the inner sides of the pair of opposed fork-shaped sheets; a layer of adhering agent is provided at the outer sides of the pair of opposed fork-shaped sheets; a bottom portion of the fork-shaped sheets is connected to the base such that an elongated channel along the longitudinal direction of the base is formed; a plurality of screw holes are distributed at an even interval on the elongated channel; two longitudinal ends of the fork-shaped rubber plate are provided with concaved or convexed mating portions, respectively, as shown in FIGS. 1-3;

wherein the tapered rubber plate is a highly flexible rubber plate having an elongated rectangular shape in the longitudinal direction and a square tapered cross-section, i.e. an upper end of the tapered rubber plate is a square and a lower end thereof are two slopes inclined outwardly; the two outwardly inclined slopes of the tapered rubber plate match with the inwardly inclined slopes at the top of the fork-shaped sheets of the fork-shaped rubber plate; a plurality of screw holes are provided at an even interval along the longitudinal direction of the tapered rubber plate at the center of cross direction thereof, the plurality of screw holes of the tapered rubber plate being in communication with the plurality of screw holes of the fork-shaped rubber plate, respectively, as shown in FIGS. 4-5;

wherein the upper and lower plates are rectangular plates provided with a plurality of screw holes at an even interval, the plurality of screw holes of the upper and lower plates being in communication with the plurality of screw holes of the fork-shaped rubber plate and the tapered rubber plate, respectively;

wherein the fastening bolt A is provided with a fixing device, wherein the fixing device includes a shaft and two rotatable latches that fit over the shaft respectively, the shaft being fixed to the top of the fastening bolt;

wherein the fastening bolt B is T-shaped;

wherein a lower portion of the fastening bolt A passes through a screw hole of the upper plate and a nut; the shaft of the fixing device is made parallel with the upper plate; the two latches provided on the shaft of the fixing device are distributed at the two sides of the fastening bolt A; then, the lower portion of the fastening bolt A passes through a screw hole of the tapered rubber plate, a screw hole of the fork-shaped rubber plate and a screw hole of the lower plate, respectively, and is fastened by a fastening nut, as shown in FIGS. 6-7;

wherein a lower portion of the fastening bolt B passes through a screw hole of the upper plate, a screw hole of the tapered rubber plate, a screw hole of the fork-shaped rubber plate and a screw hole of the lower plate, respectively, and is fastened by a fastening nut; and wherein the plurality of fastening bolts A and B alternately pass through the screw holes of the upper plate, the screw holes of the tapered rubber plate, the screw holes of the fork-shaped rubber plate and the screw holes of the lower plate, respectively, and are fastened by fastening nuts, as shown in FIG. 8.

Another technical solution of this application is an internal-angled compressive stress water stopper for forming an internal-angled concrete deformation joint.

Figure 10:
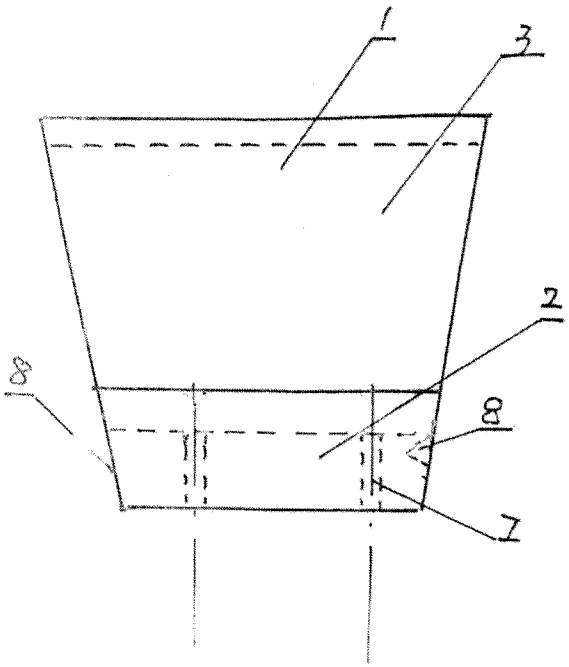
FIG. 10 is an illustrative longitudinal fork-shaped rubber plate in view or a another technical solution of this application.
Figure 11:
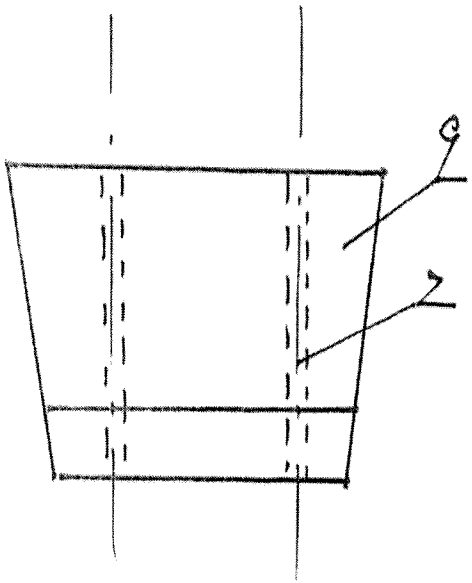
FIG. 11 is an illustrative longitudinal view of a tapered rubber plate in another technical solution of this application.

A compressive stress water stopper comprises: a fork-shaped rubber plate, a tapered rubber plate, an upper plate, a lower plate and a plurality of fastening bolts A and B;

wherein the fork-shaped rubber plate is a highly resilient rubber plate having an inverse trapezoidal shape in a longitudinal direction, as shown in FIG. 10, and having a groove-shaped cross-section; the fork-shaped rubber plate includes a base and a pair of opposed fork-shaped sheets attached to the base; the top of the fork-shaped sheet is a slope inclined inwardly; a layer of isolating agent is provided at the inner sides of the pair of opposed fork-shaped sheets; a layer of adhering agent is provided at the outer sides of the pair of opposed fork-shaped sheets; a bottom portion of the fork-shaped sheets is connected to the base such that a channel along the longitudinal direction of the base is formed; a plurality of screw holes are distributed at an even interval on the channel; two ends of the fork-shaped rubber plate are provided with concaved or convexed mating portions, respectively;

wherein the tapered rubber plate is a highly flexible rubber plate having an inverse trapezoidal shape in the longitudinal direction, the bottom angle of the trapezoid being equal to that of the longitudinal trapezoid of the fork-shaped rubber plate as shown in FIG. 11, and a square tapered cross-section, i.e., an upper end of the tapered rubber plate is a square and a lower end thereof are two slopes inclined outwardly; the two outwardly inclined slopes of the tapered rubber plate match with the inwardly inclined slopes at the top of the fork-shaped sheets of the fork-shaped rubber plate; the tapered rubber plate is provided with a plurality of screw holes at an even interval along the longitudinal direction, the plurality of screw holes of the tapered rubber plate being in communication with the plurality of screw holes of the fork-shaped rubber plate, respectively;

wherein the upper and lower plates are rectangular plates provided with a plurality of screw holes at an even interval, the plurality of screw holes of the upper and lower plates being in communication with the plurality of screw holes of the fork-shaped rubber plate and the tapered rubber plate, respectively;

wherein the fastening bolt A is provided with a fixing device, wherein the fixing device includes a shaft and two rotatable latches that fit over the shaft respectively, the shaft being fixed to the top of the fastening bolt;

wherein the fastening bolt B is T-shaped;

wherein a lower portion of the fastening bolt A passes through a screw hole of the upper plate and a nut; the shaft of the fixing device is made parallel with the upper plate; the two latches provided on the shaft of the fixing device are distributed at the two sides of the fastening bolt A; then, the lower portion of the fastening bolt A passes through a screw hole of the tapered rubber plate, a screw hole of the fork-shaped rubber plate and a screw hole of the lower plate, respectively, and is fastened by a fastening nut;

wherein a lower portion of the fastening bolt B passes through a screw hole of the upper plate, a screw hole of the tapered rubber plate, a screw hole of the fork-shaped rubber plate and a screw hole of the lower plate, respectively, and is fastened by a fastening nut; and wherein the plurality of fastening bolts A and B alternately pass through the screw holes of the upper plate, the screw holes of the tapered rubber plate, the screw holes of the fork-shaped rubber plate and the screw holes of the lower plate, respectively, and are fastened by fastening nuts.

The fork-shaped rubber plate of this application may be made of a highly resilient material, such as synthetic rubber, and the tapered rubber plate may be made of a highly flexible material, such as silicone rubber.

The shafts of the fixing devices of two adjacent fastening bolts A of this application may be securely connected, as shown in FIG. 8.

The working principle and the advantageous effect of this application are as below:

When this application needs to be installed in a deformation joint, the lengths of the upper and lower plates, of the fork-shaped rubber plate and of the tapered rubber plate as well as the number of screw holes and of the fastening bolts A and B are selected according to the various lengths of the deformation joints.

To facilitate construction, the upper and lower plates, the fork-shaped rubber plate and the tapered rubber plate should not be too long. A plurality of fork-shaped rubber plates and tapered rubber plates may be used, and a predetermined length thereof may be obtained by joining the concaved or convexed mating portions at the two sides thereof.

When a leaking concrete deformation joint is at a top position, the lower portions of a plurality of fastening bolts A and B alternately pass through the screw holes and the nuts of the upper plates, respectively. The end of the latch of the fixing device provided on the top of the fastening bolt A heads downwards and rests on a side of the upper plate. Then, this application is pressed upwards into the deformation joint. After the fixing device of the fastening bolt A reaches a predetermined position in the deformation joint, the nuts under the upper plate are fastened by a sleeve. As the upper plate is moved upwards by the nuts relative to the fixing device, the latch is expanded in the shape of an anchor. When the anchor-shaped latch is clipped between the two sides of the deformation joint, the nuts and the upper plate can't move upwards any further. Thus, the top end of the fastening bolt is secured within the deformation joint.

The two outwardly inclined slopes at the lower end of the tapered rubber plate and the inwardly inclined slopes at the top of the fork-shaped sheets of the fork-shaped rubber plate are matched to form one piece. Isolating agent is applied on the inner sides of the fork-shaped rubber plate for a predetermined thickness while non-solidified bicomponent polysulfide rubber is applied on the outer sides of the fork-shaped rubber plate for a predetermined thickness, which can fill the remaining space of the deformation joint. The tapered rubber plate and the fork-shaped rubber plate are sequentially pressed into the deformation joint by fitting their screw holes into the plurality of fastening bolts A and B that are already in the deformation joint with the tapered rubber plate at an upward position and the fork-shaped rubber plate at a downward position. The ends of the plurality of fastening bolts A and B in the screw holes at a lower portion of the fork-shaped rubber plate pass through the lower plate and are fastened by nuts. Thus, the tapered rubber plate and the fork-shaped rubber plate are further pressed into the deformation joint.

Figure 9:
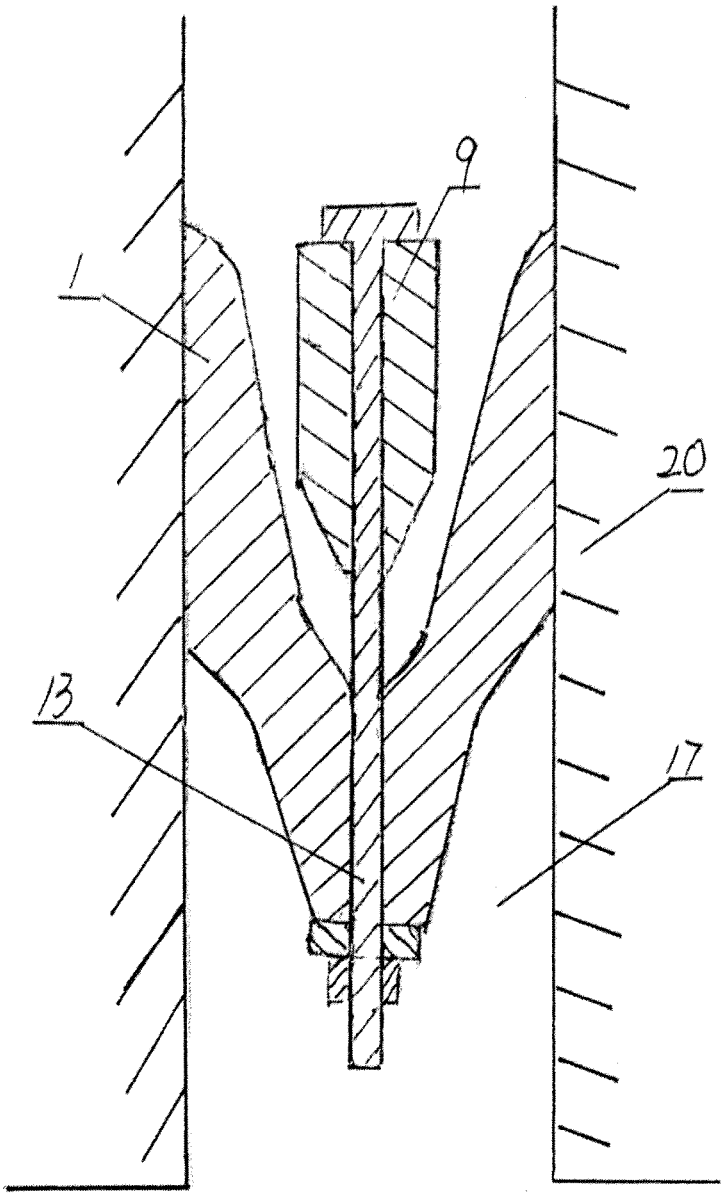
FIG. 9 is a sectional illustrative view of this application when this application deforms as the deformation joint expands.

The width of the narrowest portion of the fork-shaped rubber plate is substantially the same with the width of the deformation joint so that the narrowest portion of the fork-shaped rubber plate can be easily pressed into the deformation joint. The width of the widest portion of the fork-shaped rubber plate is greater than the width of the deformation joint. If the widest portion of the fork-shaped rubber plate is to be pressed into the deformation joint, an external three that moves the upper plate upwards by rotating the nuts will be employed. When pressed by an external force, the fork-shaped rubber plate will bend and expand laterally, so that most of the space in the deformation joint is taken up by the fork-shaped rubber plate, and the minor clearances are filled by the bicomponent polysulfide rubber, as shown in FIG. 9.

Figure 12:
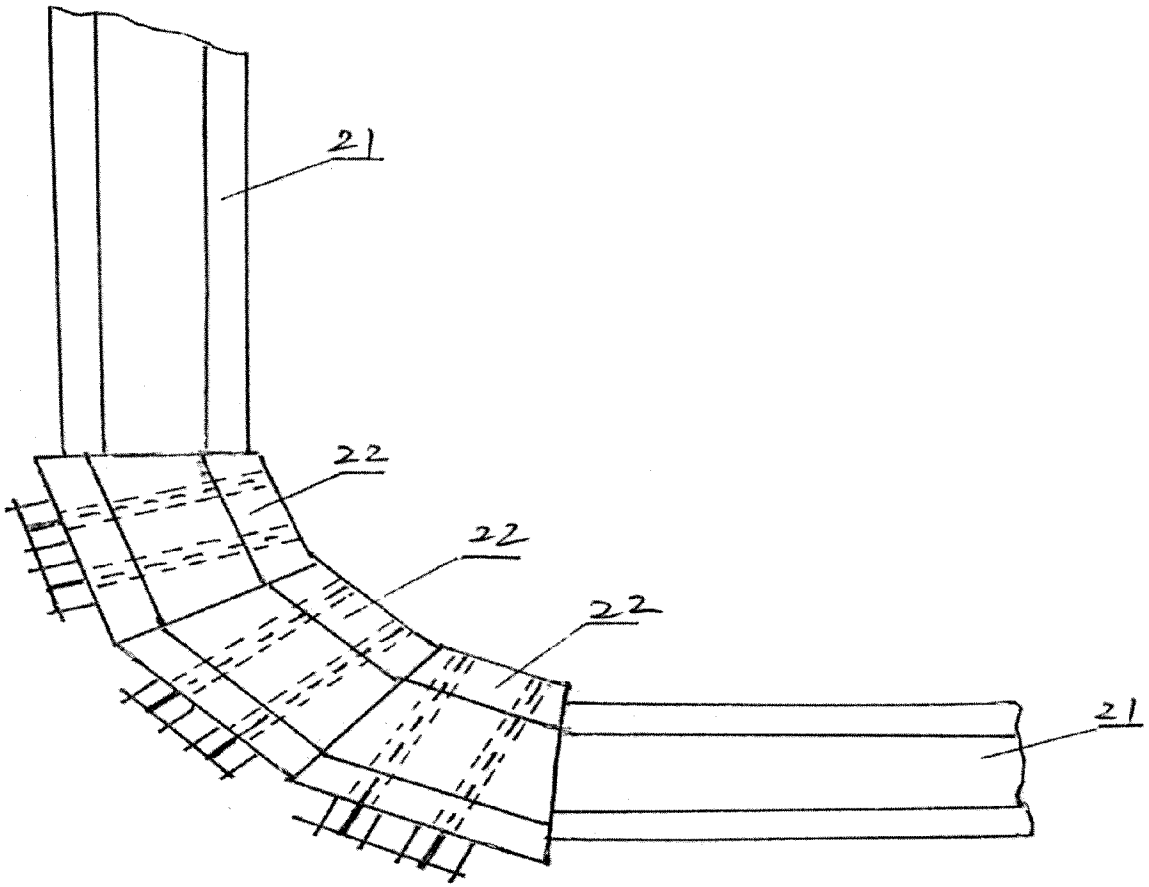
FIG. 12 is an illustrative view of another technical solution of this application in use.

If the deformation joint is located at an internal angle of a concrete structure, another technical solution of this application may be used. A plurality of connected compressive stress water stoppers with a trapezoidal shape in a longitudinal direction are used. A combined compressive stress water stopper is formed by matching the angle of the bottom angle of the trapezoid and the angle of the internal angle of the concrete structure, as shown in FIG. 12. The combined compressive stress water stopper is pressed into the deformation joint using the same method as the above.

The arrangement of the fastening bolts A and B and the fastening manner generate a stress that will cause the sides of the highly flexible tapered rubber plate and the highly resilient fork-shaped rubber plate to expand towards the both sides of the deformation joint. Such a stress and the adhesive property of the bicomponent polysulfide rubber can securely adhere the fork-shaped sheets of the fork-shaped rubber plate to the concrete surfaces at the both sides of the deformation joint. Meanwhile, the bicomponent polysulfide rubber seals the screw holes and the clearances in the concrete, thereby preventing leakage.

If the deformation joint expands and the clearances therein contract due to various reasons, the volume of the present application can be reduced when being pressed without causing any harm to the concrete at the two sides of the deformation joint. If the clearances in the deformation joint expand, the expansion stress of the present application is released and can adapt to an expansion of about 10 mm of the clearances. When the deformation joint expands for more than 10 mm, since the inner side of the fork-shaped sheets of the fork-shaped rubber plate is provided with a layer of isolating agent and the outer side thereof with a layer of adhesive agent, the internal stress generated by the adhering and fastening between the outer side thereof and the concrete pulls the fork-shaped sheets laterally, which can adapt to an expansion of 50-70 mm without disengaging the adhered portions. Thus, the maximum expansion distance can reach 80 mm or above. Therefore, the present application can act as or substitute a water stop strip in the deformation joint.

Since the deformation of the concrete is overcome by adhering and/or pulling of the bicomponent polysulfide rubber and highly flexible or resilient materials, destructive pulling forces to the concrete at the both sides of the deformation joint are avoided. Therefore, this application is better than traditional waterproof methods, such as using follow-up water stop strips or only using polysulfide rubber.

Since water stop members are inserted into the deformation joint in this application, this method may be used after or before the deformation joint is formed. If the waterproof is not desirable the water stop members may be replaced by new ones. When replacing, loosen the nuts at the lower portion of the upper plate; take away the fork-shaped rubber plate, the tapered rubber plate and the fastening bolts B; loosen the nuts on the fastening bolts A at the lower portion of the upper plate with a sleeve; loosen the latches of the fixing device at the top of the fastening bolts A; pull out the fastening bolts A. Then, replacement can be started.

In conclusion, the application range and prospect of this application are wider and better than traditional waterproof methods.

To sum up, this application provides a compressive stress water stopper that functions as or substitutes a water stop strip in a concrete deformation joint. The compressive stress water stopper may be pre-installed before casting concrete or installed after concrete is cast. The present application can be securely adhered to the concrete at the two sides of the deformation joint by way of compressive stress thereof and can adapt to long-term deformation in the deformation joint. Thus, leakage of the concrete deformation joint is prevented, or the defect of a water stop strip in the concrete deformation joint is well remedied.

MODES FOR CARRYING OUT THE INVENTION

A compressive stress water stopper comprises: a fork-shaped rubber plate 1, a tapered rubber plate 9, an upper plate 10, a lower plate 11 and a plurality of fastening bolts A 12 and B 13;

wherein the fork-shaped rubber plate 1 is made of a synthetic rubber material featuring high flexibility, high stretching property, wearing resistance and easy adhering; the fork-shaped rubber plate 1 includes a base 2 and a pair of opposed fork-shaped sheets 3 integrally attached to the base 2; the cross-section of the fork-shaped rubber plate 1 is groove-shaped with upward forks; the thickest portion of the base 2 is 30-50 mm and the thinnest portion thereof is 20-30 mm; the bottom of the pair of opposed fork-shaped sheets 3 is integrally attached to the base 2; the maximum distance between the outer sides of the opposed fork-shaped sheets 3, which is also at the thickest portion of the base 2, is 30-50 mm; the minimum distance between the outer sides of the opposed fork-shaped sheets 3, which is at the top of the opposed fork-shaped sheets 3, is 20-30 mm; the length of the thinnest portion of each fork-shaped sheet 3 is 7-10 mm, and the length of the thickest portion of the bottom of each fork-shaped sheet 3 is 15-25 mm;

wherein the height of the whole fork-shaped rubber plate 1 is 80-150 mm and the length thereof is 600-1000 mm;

wherein the top of the fork-shaped sheet 3 is a slope inclined inwardly; the bottom of fork-shaped sheets 3 is integrally attached to the base to form an elongated channel 6 along the longitudinal direction of the base; a screw hole 7 is provided in the elongated channel 6 at an interval of 30-100 mm for installing the fastening bolt A or B; a plurality of screw holes 7 are evenly distributed in the elongated channel 6 of each fork-shaped rubber plate 1; a layer of isolating agent 4 is provided at the inner sides of the pair of opposed fork-shaped sheets 3; a layer of adhering agent 5 is provided at the outer sides of the pair of opposed fork-shaped sheets 3; the two ends of the base 2 of the fork-shaped rubber plate 1 are respectively provided with concaved or convexed mating portions 8; adjacent fork-shaped rubber plates 1 engage with each other with the concaved or convexed mating portions 8 to connect a plurality of this applications as one piece so as to adapt to a predetermined length of the deformation joint;

wherein the thickness of the fork-shaped rubber plate 1 is designed according to the width of the deformation joint, and the length of the fork-shaped rubber plate 1 is designed to facilitate construction, wherein both of the above thickness and length can be increased or reduced according to the construction requirement;

wherein the tapered rubber plate 9 has a square tapered cross-section having a thickness of 20-30 mm and a height of 30-50 mm, wherein the two slopes of the square tapered cross-section match with the slopes at the top of the fork-shaped sheets 3 of the fork-shaped rubber plate 1; a screw hole 6 is provided at an interval of 30-100 mm along the longitudinal direction of the tapered rubber plate 9 for installing the fastening bolt A or B; the above sizes can be increased or reduced according to the construction requirement; the tapered rubber plate 9 is made of a silicone rubber material featuring high flexibility, high elasticity, wearing resistance and hard adhering;

wherein the upper plate 10 and the lower plate 11 respectively have a thickness of 0.5-2 mm, a width of 20-30 mm and a length of 90-120 mm and is provided with screw holes 7 at an interval of 30-100 mm the diameter and spacing of the screw holes 7 being the same as those of the fork-shaped rubber plate 1 and the tapered rubber plate 9;

wherein the fastening bolt A or B has a diameter of 6-12 mm and a length of 90-150 mm, the length of the screw being half of the length of the bolt, wherein the above sizes can be increased or reduced according to the construction requirement; the fastening bolt A has a fixing device 14; the fixing device 14 includes a shaft 15 and two rotatable latches 16 that fit over the shaft respectively, the shaft 15 being fixed to the top of the fastening bolt A.

The present invention is further illustrated by the following embodiments which should not be construed as limiting. The contents of all references, patents and published patent applications cited throughout this application, as well as the Figures and Tables are incorporated herein by reference.

Embodiment 1

Pre-treat a deformation joint 17 when repairing a leakage caused by absence or destruction of water stop strips in the deformation joint 17 on a roof.

Clear out the flexible fillings in the deformation joint 17. The cleaning depth depends on the width of this application. In this embodiment, the cleaning depth is 200 mm. The width of the cleaned groove should be 25-30 mm, which fits the thickness of this application so that this application can be pushed into the groove. If the width is too small, e.g., if it is smaller than 25 mm, widen the groove to a proper width with a groove cutting machine or a hydraulic band saw; if the width is too large, e.g., if it is greater than 50 mm, two rows of this application may be pushed into the groove simultaneously, or fill the groove with epoxy mortar to a proper width. During cleaning the groove, the leaking portions should be treated by grouting. For grouting methods, the Publication No. 200410071859.8 relating to nanometer waterproof cement and the Publication No. 2007101500620 relating to a pressurized grouting machine may be referred to. After treating the leakage, dry the cleaned groove with a drying gun; apply chloroprene rubber in the deformation joint 17 firstly; fill unreacted bicomponent polysulfide rubber into the deformation joint 17 after the chloroprene rubber becomes sticky.

Fill unreacted bicomponent polysulfide rubber in the gap between the pair of opposed fork-shaped sheets 3 of the fork-shaped rubber plate 1 of this application to full, and match the slopes of the tapered rubber plate 9 with the slopes of the fork-shaped sheets 3.

Insert the lower portions of a plurality of fastening bolts A 12 and B 13 alternately through the nuts 19 and the screw holes 7 of the upper plate 10; position the end of the latch 16 of the fixing device 14 provided on the top of the fastening bolt A 12 downwards and put the latch 16 on a side of the upper plate 10; press the upper plate 10 upwards into the deformation joint 17; after the fixing device 14 of the fastening bolt A 12 reaches a predetermined position in the deformation joint 17, fasten the nuts 19 under the upper plate 10 with a sleeve; as the upper plate 10 is moved upwards by the nuts 19 relative to the fixing device 14, the latch 16 is expanded in the shape of an anchor; when the anchor-shaped latch 16 is clipped between the two sides of the deformation joint 17, the nuts 19 and the upper plate 10 can't move upwards any further; thus, the top of the fastening bolt A 12 is secured within the deformation joint 17.

Match the two outwardly inclined slopes at the end of the tapered rubber plate 9 and the inwardly inclined slopes at the top of the fork-shaped sheets 3 of the fork-shaped rubber plate 1 to form one piece; apply non-solidified bicomponent polysulfide rubber on the outer sides of the fork-shaped rubber plate 1 for a predetermined thickness, which can fill the remaining space of the deformation joint 17; press the tapered rubber plate 9 and the fork-shaped rubber plate 1 into the deformation joint 17 by fitting their screw holes 7 over the plurality of fastening bolts A12 and B13 that are already in the deformation joint 17 with the tapered rubber plate 9 at an upward position and the fork-shaped rubber plate 1 at a downward position; fit the lower plate 11 over the ends of the plurality of fastening bolts A 12 and B 13 at a lower portion of the screw holes 7 of the fork-shaped rubber plate 1, and fasten the fastening bolts A 12 and B 13 with nuts 19; thus, the tapered rubber plate and the fork-shaped rubber plate are further pressed into the deformation joint 17.

If the length of the deformation joint 17 is greater than that of the present application, a plurality of the present applications may be connected as one piece by the concaved or convexed mating portions 8 at the two sides of the fork-shaped rubber plate 1.

After pressing the present application into the deformation joint 17, when fastening the fastening bolts, compressive stress is generated between the fork-shaped rubber plate 1 and the tapered rubber plate 9. Due to the compressive stress, the fork-shaped rubber plate 1 is bent and expanded, which allows the bicomponent polysulfide rubber to securely adhere the concrete at the two sides of the deformation joint 17 with the present application.

Embodiment 2

Before casting concrete, provide the present application to substitute water stop strips at the position where polyphenyl foam plates would have been installed in the deformation joint 17.

Fill unreacted bicomponent polysulfide rubber between the two fork-shaped sheets 3 of the fork-shaped rubber plate 1 of the present application to full; connect the fork-shaped rubber plate 1 with the tapered rubber plate 9 with a plurality of fastening bolts A 12 and B 13 to form the present application; and fix this application at a predetermined position in the deformation joint 17. The fixing method may adopt iron wire frame bonding or single-side concrete adhering, which is the same as the traditional methods for disposing and fixing foam fillings in the deformation joint 17. In order to adapt to the length of the deformation joint 17, a plurality of the present applications can be connected with the concaved or convexed portions 8. After installing, fasten the fastenings bolts A 12, B 13 with nuts 19 with a length of about ⅓ of the screw and let the bicomponent polysulfide rubber in the fork-shaped rubber plate 1 seal the screw holes automatically.

After casting the concrete, this application is separated between two blocks of concrete. Thus, the function of sealing the deformation joint 17 is realized. If leakage occurs to the deformation joint 17, the fastenings bolts A12, B13 may be further fastened, so that the fork-shaped rubber plate 1 expands for the same volume with the clearance of the deformation joint 17, thereby eliminating leakage. Meanwhile, under the expanding stress, the non-setting adhesive will be securely attached to the concrete, which is capable of coping with future greater deformations without leakage.

Embodiment 3

If the deformation joint is located at an internal angle of 90 degrees of a concrete structure, connect three compressive stress water stoppers having trapezoidal shape in longitudinal direction, the bottom angle of the trapezoid being 75 degrees; and press the connected three compressive stress water stoppers into the deformation joint with an internal angle of 90 degrees using the normal construction method. Thus, leakage is controlled.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims. The claims are intended to cover the claimed components and steps in any sequence which is effective to meet the objectives there intended, unless the context specifically indicates the contrary.

What is claimed is:

1. A compressive stress water stopper comprising a fork-shaped rubber plate, a tapered rubber plate, an upper plate, a lower plate and a plurality of fastening bolts A and B;

wherein the fork-shaped rubber plate is a resilient rubber plate having an elongated rectangular shape in a longitudinal direction and a groove-shaped cross-section; the fork-shaped rubber plate includes a base and a pair of opposed fork-shaped sheets attached to the base; the top of each fork-shaped sheet is a slope inclined inwardly; a layer of isolating agent is provided at inner sides of the pair of opposed fork-shaped sheets; a layer of adhering agent is provided at outer sides of the pair of opposed fork-shaped sheets; a bottom portion of the fork-shaped sheets is connected to the base such that an elongated channel along the longitudinal direction of the base is formed; a plurality of screw holes are distributed at an even interval on the elongated channel; two longitudinal ends of the fork-shaped rubber plate in the longitudinal direction are provided with concaved or convexed mating portions, respectively;

wherein the tapered rubber plate is a flexible rubber plate having an elongated rectangular shape in a longitudinal direction and a tapered square cross-section, wherein an upper end of the tapered rubber plate is a square and a lower end thereof are two slopes inclined outwardly; the two outwardly inclined slopes of the tapered rubber plate match with the inwardly inclined slopes at the top of the fork-shaped sheets of the fork-shaped rubber plate; a plurality of screw holes are provided at an even interval along the longitudinal direction of the tapered rubber plate at the center of cross direction thereof, the plurality of screw holes of the tapered rubber plate being in communication with the plurality of screw holes of the fork-shaped rubber plate, respectively;

wherein the upper and lower plates are rectangular plates provided with a plurality of screw holes at an even interval, the plurality of screw holes of the upper and lower plates being in communication with the plurality of screw holes of the fork-shaped rubber plate and the tapered rubber plate, respectively;

wherein each fastening bolt A is provided with a fixing device, wherein the fixing device includes a shaft and two rotatable latches that fit over the shaft respectively, the shaft being fixed to the top of the fastening bolt;

wherein each fastening bolt B is T-shaped;

wherein a lower portion of each fastening bolt A passes through a screw hole of the upper plate and a nut; the shaft of the fixing device is made parallel with the upper plate; the two latches provided on the shaft of the fixing device are distributed at two sides of the respective fastening bolt A; then, the lower portion of a fastening bolt A passes through a screw hole of each tapered rubber plate, a screw hole of the fork-shaped rubber plate and a screw hole of the lower plate, respectively, and is fastened by a fastening nut;

wherein a lower portion of each fastening bolt B passes through a screw hole of the upper plate, a screw hole of the tapered rubber plate, a screw hole of the fork-shaped rubber plate and a screw hole of the lower plate, respectively, and is fastened by a fastening nut; and wherein the plurality of fastening bolts A and B alternately pass through the screw holes of the upper plate, the screw holes of the tapered rubber plate, the screw holes of the fork-shaped rubber plate and the screw holes of the lower plate, respectively, and are fastened by fastening nuts.

2. The compressive stress water stopper according to claim 1, wherein the fork-shaped rubber plate is made of synthetic rubber and the tapered rubber plate is made of silicone rubber.

3. The compressive stress water stopper according to claim 1, wherein the shafts of the fixing devices of two adjacent fastening bolts A is capable of being interconnected.

4. A compressive stress water stopper comprising a fork-shaped rubber plate, a tapered rubber plate, an upper plate, a lower plate and a plurality of fastening bolts A and B;

wherein the fork-shaped rubber plate is a resilient rubber plate having a trapezoidal shape in a longitudinal direction and a groove-shaped cross-section; the fork-shaped rubber plate includes a base and a pair of opposed fork-shaped sheets attached to the base; the top of each fork-shaped sheet is a slope inclined inwardly; a layer of isolating agent is provided at inner sides of the pair of opposed fork-shaped sheets; a layer of adhering agent is provided at outer sides of the pair of opposed fork-shaped sheets; a bottom portion of the fork-shaped sheets is connected to the base such that an elongated channel along the longitudinal direction of the base is formed; a plurality of screw holes are distributed at an even interval on the elongated channel; two longitudinal ends of the fork-shaped rubber plate in the longitudinal direction are provided with concaved or convexed mating portions, respectively;

wherein the tapered rubber plate is a highly flexible rubber plate having a trapezoidal shape in the longitudinal direction, the bottom angle of the trapezoid being equal to that of the trapezoid of the fork-shaped rubber plate in the longitudinal direction, and having a tapered square cross-section, an upper end of the tapered rubber plate is a square and a lower end thereof are two slopes inclined outwardly; the two outwardly inclined slopes of the tapered rubber plate match with the inwardly inclined slopes at the top of the fork-shaped sheets of the fork-shaped rubber plate; a plurality of screw holes are provided at an even interval along the longitudinal direction of the tapered rubber plate at the center of cross direction thereof, the plurality of screw holes of the tapered rubber plate being in communication with the plurality of screw holes of the fork-shaped rubber plate, respectively;

wherein the upper and lower plates are rectangular plates provided with a plurality of screw holes at an even interval, the plurality of screw holes of the upper and lower plates being in communication with the plurality of screw holes of the fork-shaped rubber plate and the tapered rubber plate, respectively;

wherein each fastening bolt A is provided with a fixing device, wherein the fixing device includes a shaft and two rotatable latches that fit over the shaft respectively, the shaft being fixed to the top of the fastening bolt;

wherein each fastening bolt B is T-shaped;

wherein a lower portion of each fastening bolt A passes through a screw hole of the upper plate and a nut; the shaft of the fixing device is made parallel with the upper plate; the two latches provided on the shaft of the fixing device are distributed at two sides of the respective fastening bolt A; then, a lower portion of each fastening bolt A passes through a screw hole of the tapered rubber plate, a screw hole of the fork-shaped rubber plate and a screw hole of the lower plate, respectively, and is fastened by a fastening nut;

wherein a lower portion of each fastening bolt B passes through a screw hole of the upper plate, a screw hole of the tapered rubber plate, a screw hole of the fork-shaped rubber plate and a screw hole of the lower plate, respectively, and is fastened by a fastening nut; and wherein the plurality of fastening bolts A and B alternately pass through the screw holes of the upper plate, the screw holes of the tapered rubber plate, the screw holes of the fork-shaped rubber plate and the screw holes of the lower plate, respectively, and are fastened by fastening nuts.

5. The compressive stress water stopper according to claim 4, wherein the fork-shaped rubber plate is made of synthetic rubber and the tapered rubber plate is made of silicone rubber.

6. The compressive stress water stopper according to claim 4, wherein the shafts of the fixing devices of two adjacent fastening bolts A is capable of being interconnected.

* * * * *